US009586751B1

(12) United States Patent
Swift

(10) Patent No.: US 9,586,751 B1
(45) Date of Patent: Mar. 7, 2017

(54) DISPENSING SYSTEMS AND USES FOR SEALANT COMPOSITIONS

(71) Applicant: Swift Maintenance Products, Inc., Weston, FL (US)

(72) Inventor: Philip Swift, Weston, FL (US)

( * ) Notice: Subject to any disclaimer, the term of this patent is extended or adjusted under 35 U.S.C. 154(b) by 121 days.

(21) Appl. No.: 14/588,893

(22) Filed: Jan. 2, 2015

Related U.S. Application Data

(60) Provisional application No. 61/923,615, filed on Jan. 3, 2014.

(51) Int. Cl.

| | |
|---|---|
| ***B43K 5/04*** | (2006.01) |
| ***B65D 83/14*** | (2006.01) |
| ***B65D 83/30*** | (2006.01) |
| *B65D 83/44* | (2006.01) |

(52) U.S. Cl.
CPC ..... *B65D 83/752* (2013.01); *B65D 83/14* (2013.01); *B65D 83/303* (2013.01); *B65D 83/44* (2013.01); *Y10S 528/901* (2013.01)

(58) Field of Classification Search
CPC ..... B65D 83/14; B65D 83/44; B54D 83/303; Y10S 528/901
USPC ..... 401/190
See application file for complete search history.

(56) References Cited

U.S. PATENT DOCUMENTS

| | | | | |
|---|---|---|---|---|
| 3,189,576 | A | 6/1965 | Sweet | |
| 3,414,171 | A * | 12/1968 | Grisham | B65D 83/303 222/402.14 |
| 3,528,941 | A * | 9/1970 | Murphy | C08L 83/04 524/864 |
| 3,579,469 | A * | 5/1971 | Grenoble | D21H 19/32 524/588 |
| 3,607,972 | A | 9/1971 | Kiles et al. | |
| 3,609,178 | A | 9/1971 | Thomas | |
| 3,962,160 | A | 6/1976 | Beers et al. | |
| 4,555,560 | A | 11/1985 | Saruyama et al. | |
| 5,733,960 | A | 3/1998 | Altes et al. | |
| 7,134,579 | B2 * | 11/2006 | Scheindel | B65D 83/48 222/402.1 |

FOREIGN PATENT DOCUMENTS

| | | | |
|---|---|---|---|
| EP | 0704494 | A2 | 4/1996 |
| EP | 0713902 | A2 | 5/1996 |
| GB | 1089590 | A | 11/1967 |
| WO | 9532245 | A1 | 11/1995 |

* cited by examiner

*Primary Examiner* — Jennifer C Chiang
(74) *Attorney, Agent, or Firm* — Banner & Witcoff, Ltd.

(57) ABSTRACT

Dispensing systems for sealants, including room temperature vulcanizable (RTV) silicone sealants, are disclosed. These systems are not only simple to use, but also improve the precision with which the user can dispense product, resulting in a more satisfactory appearance and reduced product waste.

20 Claims, 2 Drawing Sheets

DISPENSING SYSTEMS AND USES FOR SEALANT COMPOSITIONS

CROSS-REFERENCE TO RELATED APPLICATIONS

This application claims priority to U.S. Provisional Application Ser. No. 61/923,615, filed Jan. 3, 2014, the contents of which are hereby incorporated by reference in its entirety.

FIELD OF THE INVENTION

The present invention relates to pressurized dispensing systems for sealant compositions, and especially for room temperature vulcanizable (RTV) silicone sealants. The dispensing systems provide a number of desirable characteristics, including ease of use, control, and accuracy. The invention also relates to a broad range of applications for sealant compositions dispensed as described herein.

DESCRIPTION OF RELATED ART

Silicone sealants are recognized in the art as flexible products that can be used for effectively sealing gaps and thereby providing an insulating barrier against the influx of external air and/or moisture. Even after full curing, silicone sealants remain pliable and adhesive, making these products ideal for sealing gaps between similar or dissimilar materials (e.g., metal and plastic). Furthermore, silicone sealants are known to withstand very high temperatures, rendering them suitable for applications involving high heat exposure (e.g., for sealing engine gaskets).

Silicone sealants are available in a variety of different forms. One form is a two-component system that requires mixing of the components immediately before use, in order to initiate the curing (vulcanization) reaction that forms the finished, flexible product. This need for mixing adds to the overall complexity of the sealant application process. More common are silicone sealant formulations that are prepared as a single component, with no mixing required. A particular class of single-component silicone sealants is known as room temperature vulcanizable (RTV). RTV silicone sealants begin to cure upon exposure the air, or, more precisely, upon exposure to moisture in the air. The simplicity of these sealants is recognized as being advantageous in insulating residential or commercial buildings, through the sealing of gaps, joints, and crevices.

The vulcanizing agent in RTV silicone sealant is a cross-linking compound (i.e., "cross-linker") having multiple pendant, hydrolyzable groups. Typically, such cross-linkers are substituted silanes, with the hydrolyzable substituents or groups having the capability to provide sites of cross-linking between separate polysiloxane polymer chains. More specifically, these hydrolyzable groups are liberated upon exposure to moisture, leaving behind reactive hydroxyl (—OH) groups that form covalent siloxane, —Si—O—Si—, linkages (i.e., cross links) between the previously separate polymer chains. RTV silicone sealants are therefore typically contained (prior to use), as hydrolyzable group, end-capped polysiloxanes (e.g., poly(di-organo siloxanes)) that are formed as the reaction product between a reactive, hydroxyl end-capped polyorganosiloxane and a cross-linker having at least three (e.g., three or four), pendant hydrolyzable groups. Because the initial reaction between the polyorganosiloxane and substituted silane cross-linker liberates one of the hydrolyzable substituents, the resulting reaction product (i.e., the form in which RTV silicone sealants are normally contained/stored) is end-capped with two or three of these substituents, providing for the possibility of branching, i.e., cross-linking, between polysiloxane polymer chains. RTV silicone sealant formulations are described, for example, in U.S. Pat. No. 3,189,576; U.S. Pat. No. 5,733,960; EP 0660838 B1; and U.S. Pat. No. 8,609,797, and their disclosures of possible RTV silicone sealant formulations, including the various polyorganosiloxane polymers, as well as the and tri- and tetra-functional cross-linkers, are incorporated by reference.

Despite the popularity of RTV silicone sealants and their superior performance in various sealing and insulating applications, known methods for dispensing these formulations are associated with a number of notable disadvantages. For example, RTV silicone sealants are conventionally applied using a caulk gun that imparts external, mechanical pressure on a caulk tube to forcefully eject the product. Control of the rate at which sealant is dispensed is difficult, as this rate is a function of a highly variable, applied mechanical pressure as well as the size of the caulk tube opening, which itself can be varied (e.g., by cutting the end of the tube to form various opening sizes). In addition, the application of, and release of, the mechanical pressure on the caulk tube does not instantaneously start and stop the flow of sealant, due to the significant inertia involved with such dispensing systems, which in turn stems in part from the highly viscous nature of most silicone sealant formulations. As a result, flow control and precision can be greatly compromised, often requiring post-application remedies such as shaping of the caulk bead (e.g., with the user's finger or a separate tool) and removal of excess material, both of which generally lead to a less than satisfactory outcome, e.g., in terms of appearance and waste. Finally, it is noted that, once opened, caulk tubes must be effectively closed off from ambient air to prevent the remaining contents from hardening. This is not easily achieved over long storage periods, and, as a consequence, unused silicone sealant that remains in opened caulk tubes often ends up being rendered useless and thrown away.

There is therefore a need in the art for silicone sealant dispensing systems that overcome the drawbacks noted above. There is also need for such dispensing systems that are suitable for applications requiring a significant degree of control and accuracy.

SUMMARY OF THE INVENTION

The present invention is associated with the discovery of dispensing systems for sealants, including RTV silicone sealants, that are not only simple to use, but can also improve the precision with which the ordinary user can dispense product, resulting in a more satisfactory appearance and reduced product waste. In many cases, the dispensing systems do not include the aid of a conventional caulk gun. That is, rather than mechanical pressure being applied externally to dispense sealant, in preferred embodiments the dispensing system is pressurized internally to a uniform pressure with a suitable propellant (e.g., a volatile component such as difluoroethane). The simple activation, or opening, of a valve (e.g., by the application of a bending force on an outlet nozzle) discharges sealant at the precise time and location desired by the user, and the closing of the valve (e.g., by the release of such a bending force) immediately stops the sealant discharge. Due to the constant internal pressure exerted by the high vapor pressure propellant, the product release rate is uniform and controllable. Due to the user's ability to easily and intuitively open or close an outlet valve of the dispensing system (e.g., by varying the bending force on an outlet nozzle as sealant is being applied), placement of the sealant to desired areas is precise and waste is minimized. Moreover, whenever the dispensing system is not in use, exposure to ambient air is automatically stopped, due to closure of the outlet valve upon the release of forces that are required by the user to maintain sealant discharge. Unlike the situation encountered with conventional caulk tubes, whereby the user must take active steps to adequately seal the tube opening following use, the dispensing systems described herein are less prone to result in the unwanted curing and waste of unused portions of sealant.

The sealants, and particularly the dispensing systems for these sealants, described herein, are compatible with a number of specific uses where control of the dispensing rate and accuracy in the placement of the dispensed product are important considerations for achieving a successful outcome. The dispensing systems described herein are therefore useful in any caulking, bonding, and/or sealing method in which an attractive finish due to accurate placement of sealant (e.g., a well-formed and uniform caulk "bead") is desirable. Representative methods include, for example, filling and/or waterproofing cracks, holes, and/or joints while forming a barrier (i.e., sealing) against external elements such as water, rain, wind, air, condensate, sleet, snow, ice, insects, rodents, mold, mildew, fungus, chemicals, etc. Various materials (substrates) to which sealants may be applied (e.g., using the dispensing systems described herein) include broadly any of those that can benefit from the placement of a rubberized coating over at least a portion thereof (e.g., in the vicinity of a junction or a crack, hole, or other defect). Representative materials, to which the sealant may be applied at a surface thereof or otherwise at a junction, crack, crevice, or hole, include porcelain, tile, glass, metal, concrete, paper, fabric, etc. More specific types of substrates include sinks, showers, tiles, tubs, toilets, grout, and piping (e.g., plumbing fixtures).

More specific applications, such as applications which are not normally associated with the placement of sealant using a conventional caulk gun and caulk tube dispensing system, include bonding and/or adhesive applications such as the repair of household items and clothing items (e.g., the repair of cracks and/or chips in flowerpots and coffee cups, the repair of soles of shoes and tears in fabrics, the hemming of pants, etc.). The dispensing systems and sealants described herein may be used for repairing small and large leaks in any type of container (e.g., bowls, cups, buckets, etc., which may be made of plastic, glass, porcelain, etc.). Other specific applications include the sealing of residential or vehicular internal spaces including windows, vents, skylights, etc. of homes, townhomes, condominiums, apartments, cars, boats, recreational vehicles (RV's) and campers, etc. Further applications include the dispensing of sealant for soundproofing, such as during the installation of speakers or construction of speaker cabinets in residential and vehicular internal spaces, including those spaces (e.g., homes, cars, and boats) described immediately above. Yet other applications include those associated with crafts and hobbies, such as in the construction and repair of models (e.g., model airplanes, model cars, and other model vehicles) and figurines, as well as in their decoration (e.g., by molding, drawing, and/or painting of models and/or figurines).

Figure 1:
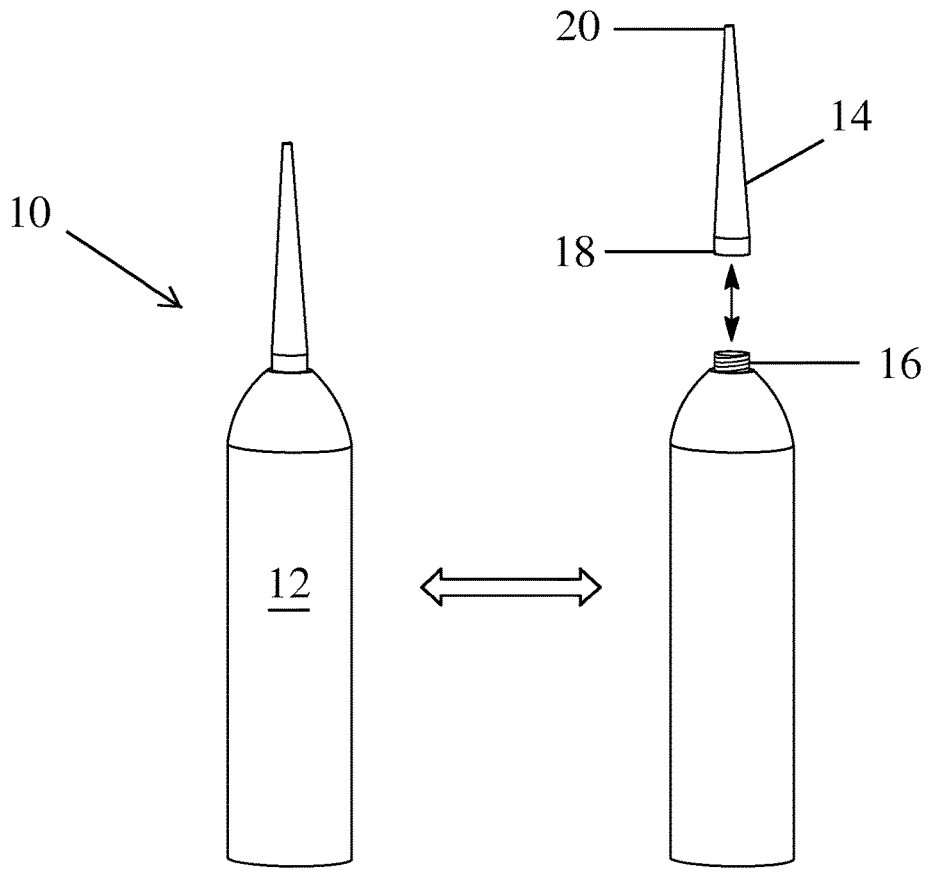
FIG. 1 depicts a representative dispensing system for a pressurized, RTV silicone sealant composition.
Figure 2:
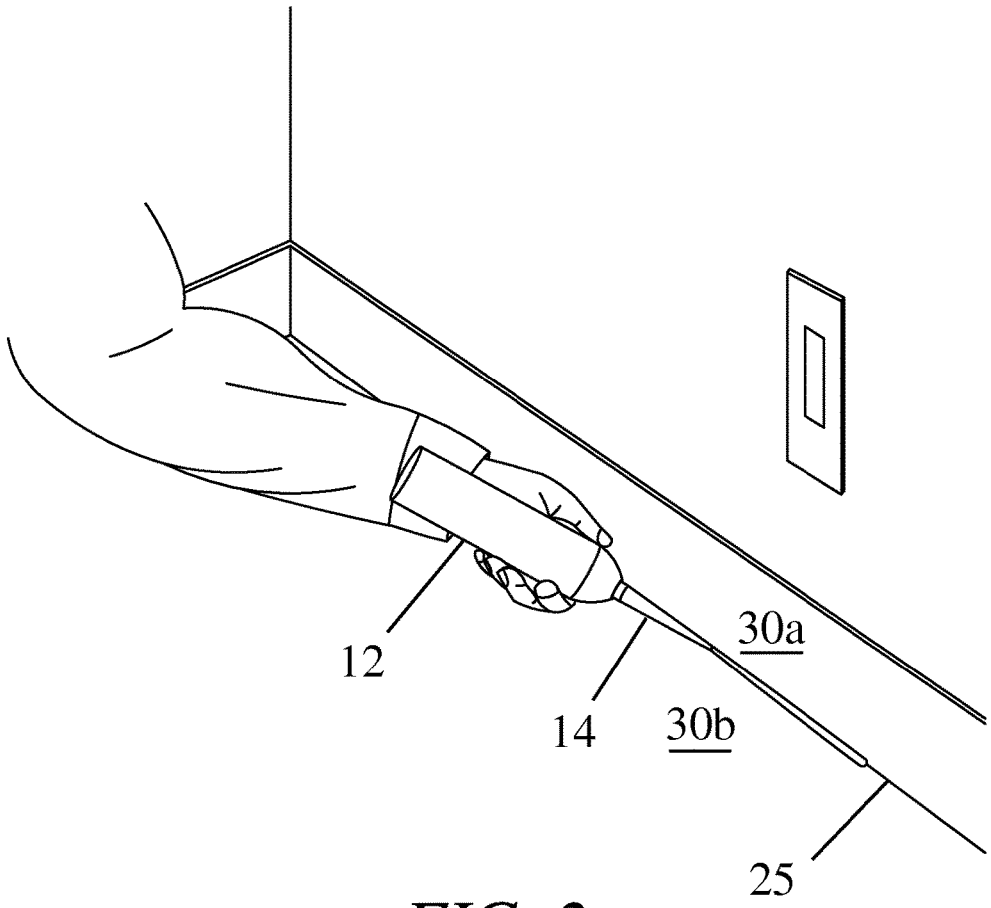
FIG. 2 depicts a representative dispensing system, being used to apply RTV silicone sealant to a joint surface.

The features referred to in FIGS. 1 and 2 are not necessarily drawn to scale and should be understood to present an illustration of the invention and/or principles involved. Some features depicted have been enlarged or distorted relative to others, in order to facilitate explanation and understanding. Other dispensing systems, according to other embodiments described herein, may have different dimensions, components, and/or component configurations, as dictated at least in part by the intended application and the environment in which they are used.

DETAILED DESCRIPTION

Particular aspects of the present invention are directed to dispensing systems comprising a container that contains, under superatmospheric pressure, a room temperature vulcanizable (RTV) silicone sealant composition comprising polyorganosiloxane molecules having at least one terminal moiety of Formula I(a) or Formula I(b):

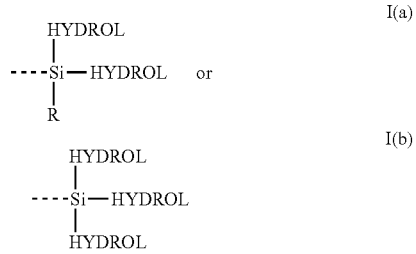

HYDROL in Formulas I(a) and I(b) represents a hydrolyzable group that is released upon exposure to ambient moisture, providing cross-linking sites. Therefore, the terminal moieties of Formulas I(a) and I(b) provide two and three possible cross-liking sites, respectively, following hydrolysis (i.e., reaction with ambient $H_2O$) to form reactive, terminal silanol groups (—Si—OH) and parent molecules that are formed from the hydrolyzable groups. Representative hydrolyzable groups include ketoximino groups (e.g., methyl ethyl ketoximino, methyl propyl ketoximino, and methyl isopropyl ketoximino), carboxy groups (e.g., acetoxy and propionoxy), and alkoxy groups (e.g., ethoxy and propoxy). Therefore, the corresponding parent molecules that are released upon hydrolysis of these hydrolyzable groups include ketoximes (e.g., methyl ethyl ketoxime, methyl propyl ketoxime, and methyl isopropyl ketoxime), carboxylic acids (e.g., acetic acid and priopionic acid), and alcohols (e.g., ethanol and propanol). These and other hydrolyzable groups are known in the art and described, for example, in U.S. Pat. No. 3,189,576; U.S. Pat. No. 5,733,960; EP 0660838 B1; and U.S. Pat. No. 8,609,797, which are incorporated by reference with respect to their disclosure of these hydrolyzable groups. The different occurrences of HYDROL in Formulas I(a) and I(b) can represent the same or different hydrolyzable groups.

The substituent R in Formula I(a), which is not a hydrolyzable group, can represent a hydrocarbon radical, an oxygenated hydrocarbon radical, or a halogenated hydrocarbon radical. Representative hydrocarbon radicals have from 1 to 10 carbon atoms and may be straight-chained, branched, or cyclic. They may also be saturated or unsaturated. Examples include methyl, ethyl, propyl, isopropyl, cyclohexyl, phenyl, methylphenyl (benzyl) and vinyl. Specific hydrocarbon radicals include $C_1$-$C_8$ alkyl radicals, $C_3$-$C_6$ cycloalkyl radicals, $C_2$-$C_5$ alkenyl radicals, and aryl radicals (i.e., derived from aromatic hydrocarbons). Representative oxygenated hydrocarbon radicals include the same radicals as discussed above with respect to hydrocarbon radicals, but wherein one or more carbon atoms is replaced by an oxygen atom, or otherwise substituted with one or more hydroxyl groups (—OH) and/or a carbonyl group (═O). Representative halogenated hydrocarbon radicals include the same radicals as discussed above with respect to hydrocarbon radicals, but wherein one or more carbon atoms is substituted with one or more halogen radicals independently selected from the group consisting of —F, —Cl, —Br, and —I.

Representative polyorganosiloxane molecules, which are end-capped with a terminal moiety of Formula I(a) or Formula I(b) above, include poly(di-organo siloxanes) in which silicon atoms of the repeating —Si—O— polymer backbone units are substituted with two similar or different organic radicals (e.g., hydrocarbon radicals such as methyl, as discussed above). Therefore, representative poly(di-organo siloxane) molecules in the sealant compositions may a have a backbone structure according to Formula II(a):

II(a)

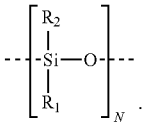

The variable N for a given poly (di-organosiloxane) molecule represents its degree of polymerization. Typically, N (or the average value for N for all polymer molecules in the sealant composition) is such that the viscosity of the sealant composition varies from about 100 to about 350,000 centipoise (cP), and often from about 5,000 to about 150,000 cP. The $R_1$ and $R_2$ organo radicals may be independently hydrocarbon radicals, oxygenated hydrocarbon radicals, or halogenated hydrocarbon radicals as discussed above. Specific, representative $R_1$ and $R_2$ groups therefore include methyl, ethyl, propyl, butyl, phenyl, methylphenyl (benzyl), ethylphenyl, vinyl, allyl, cyclohexyl, tolyl, and isopropyl. Other representative $R_1$ and $R_2$ groups include chloropropyl, 3,3,3-trifluoropropyl, chlorophenyl, beta-(perflourobutyl) ethyl, and chlorocyclohexyl.

The polyorganosiloxane molecules in representative RTV silicone sealant compositions described herein are therefore generally the reaction products of (A) a poly(di-organo siloxane according to Formula II(b):

II(b)

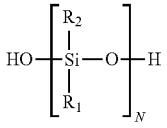

wherein N, $R_1$, and $R_2$ are as defined in Formula II(a) above, and (B) a silane cross-linker according to Formula I(c):

$$(R)_{4-n}Si(HYDROL)_n \qquad \text{I(c)}$$

wherein R and HYDROL are as defined in Formula I(a) above and n is 3 or 4. Alternatively, the silane cross-linker may also be a partial hydrolysis condensation product (e.g., a dimer, a trimer, or other oligomer), resulting from the reaction of molecules of formula I(c) with environmental moisture or process moisture. The cross-linker(s), when originally combined with the polyorganosiloxane molecules (prior to reaction) in forming the silicone sealant composition, is/are present in the composition in an amount (or combined amount in the case of a mixture of differing cross-linkers), generally from about 0.1% to about 10% by weight, and typically from about 1% to about 5% by weight.

RTV silicone sealant compositions, for use with the dispensing systems described herein, comprise a propellant having a sufficiently high volatility (vapor pressure) such that the sealant is contained under above atmospheric (superatmospheric) pressure at normal temperatures of use (e.g., room temperature). Advantageously, internal pressurization of the container (e.g., canister) promotes a uniform driving force for discharging the sealant composition, without the need for the user to estimate and apply specific level of mechanical pressure (e.g., using a conventional caulk gun) that may be too high or too low for a given task, or may otherwise be difficult to control. Representative propellants include hydrocarbons (e.g., propane and butane) and halogenated hydrocarbons such as hydrofluorocarbons (HFCs) (e.g., 1,1-difluoroethane and tetrafluoromethane). Mixtures of hydrocarbons, mixtures of halogenated hydrocarbons, or otherwise mixtures of one or more hydrocarbons with one or more halogenated hydrocarbons, may also be used as propellants. According to representative embodiments, the propellant may be present in the sealant composition in an amount, or in a combined amount in the case of a mixture, generally from about 0.5% to about 10% by weight, and typically from about 1% to about 10% by weight.

Other components of the sealant compositions can include non-reactive silicone polymers and other plasticizers, fillers, catalysts, adhesion promoters, fungicides, anti-bacterial agents, anti-mildew agents, and colorants (e.g., white, almond, and brown colorants). Non-reactive silicone polymers, which can serve as plasticizers, include poly(di-organo siloxanes) as discussed above, but end-capped with non-reactive organic radicals such as alkyl radicals (e.g., trimethylsilyl end-capped, poly(di-organo siloxanes)). Such non-reactive silicone polymers, alone or in combination with other types of plasticizers, can be used to improve extraction properties of the sealant and to modify the modulus of the cured composition. Other suitable plasticizers include compatible cycloparaffinic oils, paraffinic oils, and long chain non-reactive organic oil extenders which do not bleed or significantly evaporate from the cured sealant. Use of these oils may have long term effects on the performance of the sealant such as lower elongation and increased stiffening of the sealant. Non-reactive silicone polymers and/or other plasticizers are present in the silicone sealant composition in an amount (or combined amount in the case of a mixture of these components) generally from about 5% to about 80% by weight, and typically from about 10% to about 45% by weight.

The sealant composition may also contain a filler, which may be a reinforcing filler, a non-reinforcing filler, or mixtures thereof. Reinforced fillers include silica, such as fumed silica and precipitated silica. The fumed silica can be used "as is" or treated to provide a hydrophobic surface. Examples of treated fillers are polydimethylsiloxane, octamethylcyclotetrasiloxane, or hexamethyldisilazane. The amount and type of filler can vary with the desired properties for the end composition. Generally, fumed silicas have surface areas ranging generally from 90 to 300 $m^2$/gram, and typically from 130 to 200 $m^2$/gram. Reinforcing filler (e.g., silica), when used, may be present in the sealant composition in an amount generally from about 5% to about 50% by weight, and typically from about 10% to about 30% by weight. The use of fumed silica as a reinforcing filler can impart increased tensile strength of the cured composition as well as thixotropic character to the uncured composition. A non-reinforcing or semi-reinforcing filler can also be used. Examples of such fillers include ground or precipitated calcium carbonate (treated and untreated) and ground quartz, having a surface area from about 2 to about 90 $m^2$/gm. Other semi-reinforcing fillers or extending fillers which are known in the art may be used. These include but are not limited to silica aerogel, diatomaceous earth, iron oxide, titanium oxide, aluminum oxide, zirconium silicate, calcined clay, magnesium oxide, talc, wollastonite, hydrated alumina, and carbon black. The combined amount of one or a combination of all fillers in a given sealant composition can range generally from about 3% to about 65% by weight, and typically from about 5% to about 50% by weight.

According to other embodiments, the sealant composition may also contain an adhesion promoter. Selection of an adhesion promoter will vary with the desired application since the choice of adhesion promoter can significantly affect the degree of adhesion to substrates. The selection of adhesion promoter can also affect cure speed and modulus of the composition as well. Typically an adhesion promoter can be chosen from many organofunctional silanes known in the art. Such silanes typically have a propylene group (as the bridging group) between the functional group and the silicon atom and take the form of an organopropyl tri- or di-alkoxysilane. In some the cases the organofunctional silane may contain a methylene bridge between the functional group and the silicon atom and take the form of an organo methyl tri or di-alkoxy silane. The functional group is typically an amino, epoxy, glycidoxy, sulfur, ureido, methacryloxy or acryloxy group. Specific examples of such silanes are described in U.S. Pat. No. 8,609,797 and these silanes are hereby incorporated by reference. Adhesion promoters, when used, are present in the sealant composition in an amount generally from about 0.001% to about 2.5% by weight, and typically from about 0.5% to about 1% by weight. Mixtures of two or more of the adhesion promoters stated above can also be used, for example in these representative amounts in combination, usually to obtain improved properties such as improved resistance to hydrolysis, or improved adhesion.

The sealant composition may also contain a catalyst to facilitate the reaction between the silanol (hydroxyl group) end-capped organosiloxanes and the silane cross-linker, as discussed above. Various catalysts can be used, for example organotin carboxylates such as dibutyltindilaurate, dibutyltindiacetate, dibutyltin dioctoate, dibutyltinmaleate, dialkyl tin hexoate, dioctyltindilaurate, etc. Other catalysts include iron octanoate, zinc octanoate, lead octanoate, cobalt naphthenate, etc. Titanium compounds may also be used, such as tetrapropyltitanate, tetrabutyltitanate, tetraisopropyltitanate, etc. Dibutyltindilaurate is a preferred catalyst. When present, a catalyst, or combination of catalysts, are present in the sealant composition generally in an amount or combined amount from about 0.001% to about 1% by weight, and typically from about 0.02% to about 0.15% by weight.

Other aspects of the invention are directed to methods for using the sealant compositions described above, and particularly such methods in which compositions for bonding, sealing, or caulking of substrates, are dispensed with the dispensing systems described herein. Suitable substrates, to which the sealant compositions may be applied, include materials selected from the group consisting of porcelain, plastic, tile, glass, metal, concrete, paper, and fabric. In representative embodiments, following curing, the substrate is rendered capable of containing water in an interior surface. Substrates therefore include containers of all types, which leak (i.e., are not capable of containing water) or are otherwise defective, or may be prone to leakage, prior to the application of the sealant composition. Examples of such containers are bowls, cups, buckets, tanks, sinks, jugs, bottles, barrels, fountains, toilets, birdbaths, boats, pipes, and plumbing connections. The sealant compositions and dispensing systems described herein may be used to repair leaks arising from small holes or cracks, for example those having a maximum dimension (e.g., diameter) of ⅛ inches (3.2 mm) or less, or otherwise leaks arising from large holes or cracks, for example those having a maximum dimension (e.g., diameter) of 0.5 inches (1.3 cm) or more. According to particular embodiments, such holes or cracks may have a maximum dimension (e.g., diameter) ranging generally from about 0.5 inches (1.3 cm) to about 6 inches (15 cm), and typically from about 1 inch (2.5 cm) to about 3 inches (7.6 cm). In other representative embodiments, the sealant is applied to a repair junction or a bonding junction of the substrate and, following curing, the substrate is adhered at the repair junction or the bonding junction. In such embodiments, representative substrates include household items and clothing items as discussed above (e.g., cracked flowerpots), as well as items relating to crafts and hobbies (e.g., models and figurines).

FIG. 1 depicts a representative dispensing system 10 for a pressurized, RTV silicone sealant composition. A container, in the form of canister 12, contains the composition in a pressurized state, by virtue of the presence of a propellant in the composition. As discussed above, the internal pressure allows for a uniform and controlled application of the sealant, at the precise time and location as desired for a given application. The internal pressure in canister 12, at least prior to the first use of the sealant composition, is such that a relatively high, maximum rate of sealant can be discharged (e.g., corresponding to a rate of discharge when an internal valve (not shown) at or near outlet nozzle 16 is opened to its maximum working position). In representative embodiments, the propellant may be present in an amount sufficient to pressurize the container, such that a bead of the silicone sealant having a diameter of ⅛ inches (3.2 mm) can be dispensed from the container at a rate of generally at least about 1 inch/second (2.5 cm/second), typically at least about 2 inches/second (5.1 cm/second), and often at least about 3 inches/second (7.6 cm/second) at ambient atmospheric pressure and temperature.

However, the user's ability to easily adjust the extent of the valve opening consequently allows for fine control of the rate of discharge of the sealant composition. For example, according to one embodiment, outlet nozzle 16 is tubular and the internal valve and nozzle are configured to discharge the sealant composition at a rate that increases with an increasing displacement of an axis of the tubular outlet, from a position that is aligned with respect to the container axis, to a position of maximum operating displacement with respect to this axis. FIG. 1 depicts a configuration in which the central axis of outlet nozzle 16, as well as the central axis of canister 12, are aligned (i.e., in the vertical direction). However, by slightly bending outlet nozzle 16 to one side (e.g., offsetting outlet nozzle 16 from the vertical position), sealant may be released. An increasing degree of offset between the container axis and the axis of outlet nozzle 16 can correspond to an increasing degree of opening of a valve at outlet nozzle 16 and consequently an increasing rate of discharge of sealant. The maximum rate of discharge may correspond to a maximum degree of offset (i.e., maximum operating displacement), which may, in some cases, correspond to an offset between the container and nozzle axes of less than about 60° (e.g., from about 10° to about 60°), less than about 45° (e.g., from about 15° to about 45°), or even less than about 30° (e.g., from about 20° to about 30°).

As is also depicted in FIG. 1, dispensing system 10 also includes extension tube 14 that can improve the application of sealant in a number of ways, compared to the application using a conventional caulk gun. For example, extension tube 14 allows the placement of sealant into areas that are otherwise difficult to reach, while simultaneously allowing the user to push/press outlet nozzle 16 to the desired angle of offset, with a reduced amount of force. This lessens "finger fatigue," provides for accurate placement of the sealant, and further improves control of the sealant discharge rate. All of these factors contribute to the formation of a desired, well-defined and consistently dimensioned "bead" of material to the exact location desired. No caulk gun is required, and the sealant application can generally be made without the use of finishing steps or tools that are often needed to correct for errors in conventional, mechanically pressurized sealant applications. To achieve these important benefits, extension tube 14 will have a length of generally at least about 1 inch (2.5 cm) (e.g., from about 1 inch (2.5 cm) to about 12 inches (30 cm)), typically at least about 2 inches (5.1 cm) (e.g., from about 2 inches (5.1 cm) to about 8 inches (20 cm)), and often at least about 3 inches (7.6 cm) (e.g., from about 3 inches (7.6 cm) to about 6 inches (15 cm)). In terms of the length of extension tube 14 as a percentage of the vertical length of canister 12, this will quantity will vary generally from about 20% to about 100%, typically from about 25% to about 80%, and often from about 30% to about 60%, to achieve good handling and control characteristics. As also depicted in FIG. 1, the outer diameter of extension tube 14 may taper along its length or at least a substantial portion (e.g., from about 80% to about 95%) of its length (e.g., a portion that does not include a minor length section of constant outer diameter, which is threadably engaged with outlet nozzle 16). The same tapering features may also apply to the inner diameter of extension tube 14. The tapering of the outer diameter improves the accuracy of the sealant placement into small crevices, whereas the tapering of the inner diameter slows the sealant discharge rate, compared to sealant applications made without extension tube 14, to improve flow control. A representative range for the inner diameter of the extension tube at end 20 used to discharge sealant onto a substrate, is from about 0.1 inches (2.5 mm) to about 0.5 inches (13 mm).

Extension tube 14 in FIG. 1 is shown with a threaded connection to outlet nozzle 16, and it is therefore removable by simply unscrewing. Other connections (e.g., a snap fit, a compression fit, etc.) are possible in the case of a removable extension tube. An extension tube as described herein may also be formed integral with canister 12 and outlet nozzle 16, such that it is not removable or more difficulty removable. As shown in FIG. 1, extension tube 14 is removably attached to outlet nozzle 16 and is configured to receive, at first end 18, sealant composition that is discharged from outlet nozzle 16 and to dispense, from opposite end 20, the sealant composition to a substrate. The extension tube may be translucent or completely transparent, rendering the sealant composition visible within this tube. This provides yet further aid to the user, in the form of a visual indication of the position of the sealant and therefore an approximation of the time and rate at which it will ultimately be discharged from extension tube 14.

According to other embodiments, the axes of canister 12 and outlet nozzle 16 may be offset (e.g., at a 90° angle, an angle between 0° and 90°) when the dispensing system is not in use (e.g., an internal valve is in the closed position), and the straightening of the axis of outlet nozzle 16 with respect to the axis of canister 12 may be performed to release the sealant composition. In any event, the position of any desired axial displacement (e.g., the maximum operating displacement in the embodiment in which bending, rather than straightening, of the outlet nozzle releases the sealant) can be advantageously be achieved with normal digital (finger) pressing or bending forces, whether these forces constitute bending or straightening forces. According to the depicted use of the dispensing system in FIG. 2, a slight bending force that is applied by pressing extension tube 14 against substrate 25 (in this case a junction between two adjacent surfaces 30*a*, 30*b*), and not necessary applied by digital pressing forces, is used to release sealant composition with a desired degree of precision, accuracy, and uniformity.

Yet further aspects of the invention are directed to kits comprising, in a single package with instructions for use, a pressurized canister containing a sealant composition, as described herein, and a separate extension tube that may be removably attached to the canister. Such kits may also include multiple (e.g., two or more, for example from two to four) extension tubes of differing lengths and/or internal diameters.

Overall, aspects of the invention are directed to dispensing systems for sealant compositions that provide a number of advantages, in terms of their ability to improve control and accuracy in caulking, bonding, and sealing applications. Further aspects are directed to particular uses of these dispensing systems. Those having skill in the art, with the knowledge gained from the present disclosure, will recognize that various modifications can be made in these dispensing systems, and other uses will become apparent, without departing from the scope of the present invention.

What is claimed is:

1. A dispensing system comprising a container that contains, under superatmospheric pressure, a room temperature vulcanizable (RTV) silicone sealant composition comprising polyorganosiloxane molecules having at least one terminal moiety of Formula I(a) or Formula I(b):

I(a)

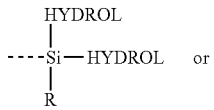

or

I(b)

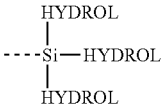

wherein HYDROL is a hydrolyzable group that is released upon exposure to ambient moisture, providing a cross-linking site, and R in Formula I(a) is a hydrocarbon radical, and oxygenated hydrocarbon radical, or a halogenated hydrocarbon radical; and wherein the composition further comprises a propellant.

2. The dispensing system of claim 1, wherein the propellant is present in an amount sufficient to pressurize the container, such that a bead of the silicone sealant composition having a diameter of ⅛ inches (3.2 mm) can be dispensed from the container at a rate of at least about 2 inches/second (5.1 cm/second) at ambient atmospheric pressure.

3. The dispensing system of claim 1, wherein the container further comprises a tubular outlet nozzle that is configured to discharge the sealant composition at a rate that increases with an increasing displacement of an axis of the tubular outlet, from a position that is aligned, to a position of maximum operating displacement, with respect to an axis of the container.

4. The dispensing system of claim 3, wherein the position of maximum operating displacement is achieved using normal digital pressing forces.

5. The dispensing system of claim 3, wherein the position of maximum operating displacement represents a displacement of at least about 30° with respect to the axis of the container.

6. The dispensing system of claim 3, further comprising an extension tube that is removably attached to the tubular outlet and configured to receive, at one end, the sealant composition discharged from the tubular outlet and to dispense, from an opposite end, the sealant composition to a substrate.

7. The dispensing system of claim 6, wherein the extension tube is translucent and the sealant composition is visible within the extension tube.

8. The dispensing system of claim 6, wherein the extension tube has a length of at least about 3 inches (7.6 cm).

9. The dispensing system of claim 6, wherein the extension tube has an inner diameter or an outer diameter that tapers along at least a portion of its length.

10. The dispensing system of claim 9, wherein both the inner diameter and the outer diameter of the extension tube taper along substantially all of its length.

11. The dispensing system of claim 1, wherein the hydrolyzable group is a ketoximino group, a carboxylic acid group, or an alkoxy group.

12. The dispensing system of claim 1, wherein the sealant composition further comprises a fungicide.

13. The dispensing system of claim 1, wherein the sealant composition further comprises a filler.

14. The dispensing system of claim 13, wherein the filler is silica and is present in the sealant composition in an amount from about 10% to about 30% by weight.

15. The dispensing system of claim 1, wherein the propellant is selected from the group consisting of a hydrocarbon, a halogenated hydrocarbon, mixtures of hydrocarbons, mixtures of halogenated hydrocarbons, and mixtures of one or more hydrocarbons with one or more halogenated hydrocarbons, and wherein the propellant is present in an amount, or in a combined amount in the case of a mixture, from about 1% to about 5% by weight.

16. A method of bonding, sealing, or caulking a substrate, the method comprising dispensing, from the dispensing system of claim 1, a room temperature vulcanizable (RTV) silicone sealant composition onto the substrate and curing the silicone sealant.

17. The method of claim 16, wherein the substrate comprises a material selected from the group consisting of porcelain, plastic, tile, glass, metal, concrete, paper, and fabric.

18. The method of claim 16, wherein, following curing, a substrate is rendered capable of containing water in an interior surface.

19. The method of claim 18, wherein the substrate is selected from the group consisting of a bowl, a cup, a bucket, a tank, a sink, a jug, a bottle, a barrel, a fountain, a toilet, a birdbath, a boat, a pipe, and a plumbing connection.

20. The method of claim 16, wherein the silicone sealant is applied to a repair junction or a bonding junction of the substrate and, following curing, the substrate is adhered at the repair junction or the bonding junction.

* * * * *